US005713528A

United States Patent [19]

Pohn

[11] Patent Number: 5,713,528

[45] Date of Patent: Feb. 3, 1998

[54] PROCESS FOR THE WINDING UP OF YARNS

[75] Inventor: Romeo Pohn, Geisenfeld, Germany

[73] Assignee: Rieter Ingolstadt Spinnereimaschinenbau AG, Ingolstadt, Germany

[21] Appl. No.: 768,979

[22] Filed: Dec. 18, 1996

[30] Foreign Application Priority Data

Dec. 29, 1995 [DE] Germany ..... 195 48 887.3

[51] Int. Cl.[6] ..... B65H 54/28; B65H 54/38; B65H 55/04

[52] U.S. Cl. ..... 242/43.1; 242/18.1; 242/177

[58] Field of Search ..... 242/43.1, 18.1, 242/174, 177

[56] References Cited

U.S. PATENT DOCUMENTS

| | | | |
|---|---|---|---|
| 4,325,517 | 4/1982 | Schippers et al. . | |
| 4,498,637 | 2/1985 | Yamamoto et al. | 242/43.1 X |
| 4,659,027 | 4/1987 | Schippers et al. | 242/43.1 X |
| 4,767,071 | 8/1988 | Hirai | 242/43.1 X |
| 4,771,960 | 9/1988 | Yamamoto et al. | 242/43.1 X |
| 5,439,184 | 8/1995 | Poppinghaus et al. | 242/18.1 |

*Primary Examiner*—Michael Mansen
*Attorney, Agent, or Firm*—Dority & Manning

[57] ABSTRACT

A winding process for winding yarn into a cross-wound bobbin in the textile machine includes depositing the yarn on a bobbin in a transversing stroke by a transversing movement of a yarn guide. The process includes intermittently decreasing the traversing stroke from a maximum value to a minimum value and then increasing the value of the traversing stroke from the minimum value back to a relatively constant maximum value and holding the stroke at the maximum value for a predetermined period of time. The traversing frequency of the yarn guide is decreased to a relatively constant minimum value substantially simultaneously with the increasing of the traversing stroke from the minimum value back to the relatively constant maximum value. The traversing frequency is maintained at the constant minimum value for a predetermined period of time. The traversing frequency of the yarn guide is then increased from the constant minimum value after the predetermined period of time. The duration of the decreasing of the traversing frequency of the yarn guide is shorter than the duration of the maximum value of the traversing stroke.

12 Claims, 3 Drawing Sheets

PROCESS FOR THE WINDING UP OF YARNS

BACKGROUND OF THE INVENTION

The present application relates to a process for the winding up of yarns into cross-wound bobbins, whereby the yarn is delivered at a constant speed, in particular to be used on open-end spinning machines. In the rotor spinning machine R1 of Rieter Ingolstadt Spinnereimaschinenbau AG, Friedrich-Ebert-Str. 84, 85046 Ingolstadt, provisions are made for the formation of the cross-wound bobbins, to feed through a back-and-forth movement of a yarn guide to tubes or bobbins driven at a constant speed. In order to avoid the known problem of ribbon winding, provisions are made for the speed of the yarn guide to fluctuate constantly around a mean value. In addition, in order to obtain a better structure of the bobbin edges, the yarn guide which is operating with a constant stroke is shifted periodically more in the direction of the left side of the bobbin and thereupon to the right side of the bobbin. This is called a so-called edge winding.

One problem with constant reduction and increase of the yarn guide speed, whereby the circumferential speed of the bobbin as well as the speed of the fed yarn remain constant, is that the yarn is subjected to constantly changing yarn tension. Through a suitable selection of the change in yarn guide speed the yarn tension can be kept within a range which winds up the yarn with sufficient tension on the bobbin without subjecting it at the same time to the danger of yarn breakage.

The known winding system has the disadvantage that the process used to avoid ribbon winding not only causes fluctuations in yarn tension but is also unfavorable for the build-up of the edges on the bobbin. In addition, the so-called edge winding is not sufficiently effective in the formation of a good bobbin edge.

A process for winding up yarns on cross-wound bobbins is presented in DE-A 29 37 601, and in this process it is not the so-called yarn winding which is used to improve the edge build-up, but the so-called shortening of the traversing stroke. Here, the return points of the yarn guide on the left and on the right side of the bobbin, and in course of bobbin build-up on both sides at the same time, are shifted periodically towards the center of the bobbin. For ribbon winding, the yarn guide speed is increased in a certain manner and is reduced with another course. In this case, the point of return of stroke for increase and reduction of yarn guide speed and the point of return from stroke reduction to stroke increase are coordinated with each other. This coordination is time-dependent and such that the two points occur at the same point in time. Traversing takes place in different cycles. A cycle consists of the time for the reduction and then increase of the traversing stroke together plus the time during which the stroke is not changed. Different cycles, in addition a different shortenings of the stroke, also have different durations. Although it is possible to improve the edge build-up with the process shown in DE-A 29 37 601, the process described here has nevertheless the disadvantage that the yarn is subjected to excessive tension fluctuations during winding.

OBJECTS AND SUMMARY OF THE INVENTION

It is a principal object of the present invention to propose a process for the winding up of yarns which is an improvement of the known processes, whereby in particular a bobbin with good edge build-up and simultaneous good ribbon winding properties and little yarn tension fluctuations are to be achieved. Additional objects and advantages of the invention will be set forth in part in the following description, or may be obvious from the description, or may be learned through practice of the invention.

The process according to the invention makes it possible, in addition to a good edge build-up, to ensure that the yarn tension fluctuations produced remain minimal. They are within a range of only one half of what occurs in the process of the above-mentioned rotor spinning machine. This is achieved in that the influences of frequency changes of the traversing guide upon the yarn tension are in part compensated for by shortening the stroke of the yarn guide. At the same time it is possible to improve the ribbon winding situation over that of the known process. It is a further advantage that in the process according to the invention, it is possible to act upon ribbon winding and yarn tension without having an improvement of the ribbon winding situation automatically cause a substantial deterioration in yarn tension fluctuations. In addition to this, the edge build-up on the bobbin is substantially improved. Furthermore, it is possible to imagine that the process according to the invention can be combined especially advantageously with the above-mentioned processes for edge winding. It is especially advantageous for the edge build-up of the bobbin if the time share of the maximum value of the traversing stroke is from 35% to 65% of the overall cycle time of winding. This makes it possible for the bobbin to be built up with an edge of uniform hardness and nevertheless to wind it up so that no ribbon winding occurs. This can be achieved advantageously by means of a change in traversing frequency which prevents inadmissible yarn tension fluctuations. With a maximum stroke share of 45% to 55% it is possible to achieve the goals of bobbin formation, a good edge, winding without ribbon winding and little yarn tension fluctuation in a good compromise.

When the traversing frequency is changed to a minimum value it is advantageous if this amounts to a time share from 10% to 30% of the overall winding cycle time. This makes it possible to achieve adaptation to the duration of the maximum value of the traversing stroke through the frequency. A time share value from 12% to 25% is especially good. It is especially advantageous for the bobbin build-up if the bobbin is not formed with an always uniformly fixed ratio between stroke shortening and frequency change in traversing, but if the bobbin is wound up in different winding cycles. These can follow each other in this case, and differentiate themselves advantageously through the evolution in time of the traversing stroke shortening or also through the evolution in time of the decrease in traversing frequency, or especially advantageously by combining both. Several different cycles together can constitute a cycle group which repeats itself periodically until the bobbin is completed. It is especially advantageous if the maximum value of the frequency of traversing coincides in time with the minimum value of the traversing stroke. This ensures that the yarn tension fluctuations are kept especially low. Further advantageous developments of the invention are described in sub-claims.

The process according to the invention is explained below through drawings.

DETAILED DESCRIPTION OF THE PREFERRED EMBODIMENTS

Figure 1:
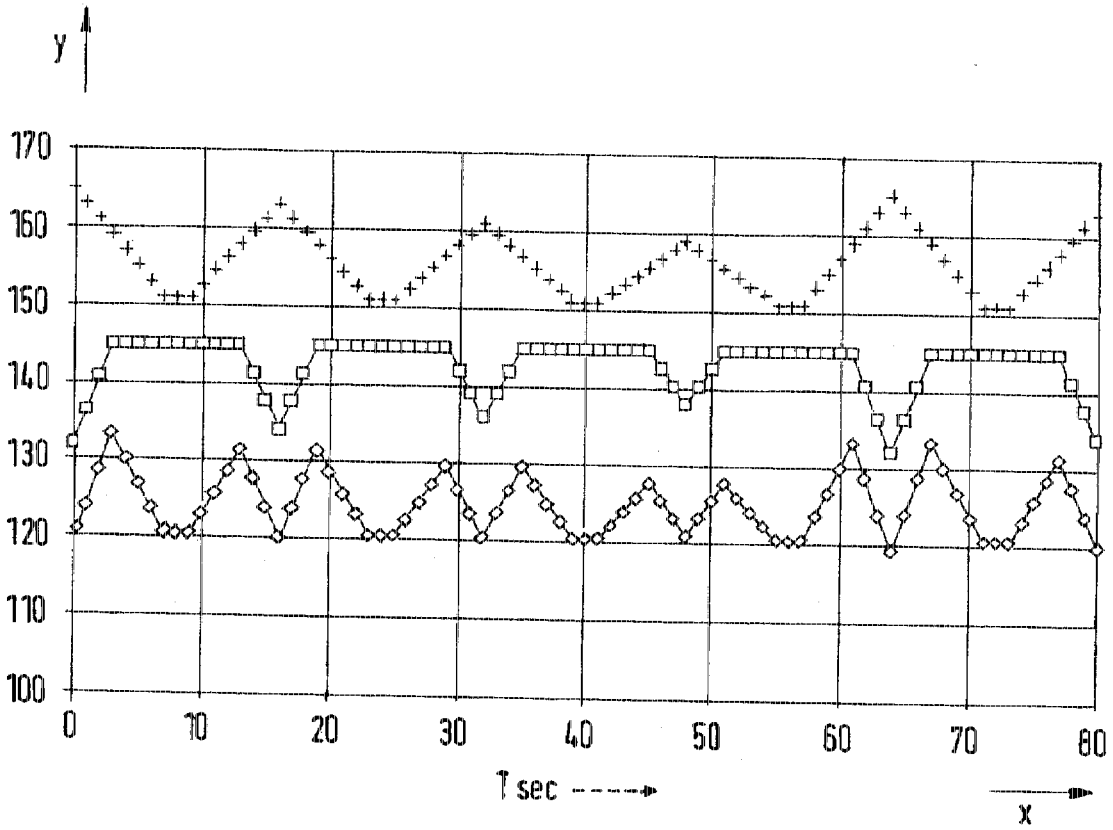
FIG. 1 is a diagram schematically showing the interrelation over time between traversing frequency, traversing stroke and yarn tension fluctuations during winding.

Reference will now be made in detail to the presently preferred embodiments of the invention, one or more embodiments of which are illustrated in the drawings. Each example is provided by way of explanation of the invention, and not as a limitation of the invention. For example, features illustrated or described as part of one embodiment, can be used on another embodiment to yield still a further embodiment. It is intended that the present invention cover such modifications and variations.

The schematic drawing of FIG. 1 shows the curves which, seen from top to bottom, represent the traversing frequency, the traversing stroke and the evolution of yarn tension. All three curves are entered over the period T so that at point in time T=0 a maximum of traversing frequency, a minimum of traversing stroke and a minimum of yarn tension appear. The values on the y axis only refer to the middle curve, the traversing stroke, and represent it in an amount in millimeters. The drawing of the diagram in FIG. 1 is such that a traversing cycle with a maximum value of the frequency of the yarn guide starts at T=0 and ends at the second maximum value of traversing at T=16 sec. The frequency reaches its minimum value shortly before half the cycle time and maintains it for 12.5% of the cycle time. Thereupon the frequency is again increased to a new maximum value. With this new, somewhat lower maximum value of the traversing frequency, the second cycle, which ends at T=32 seconds begins. The evolution of the third cycle is identical, while a new maximum value is reached at the end in the fourth cycle. The fifth to eighth cycles, which are no longer shown, evolve as the first to fourth cycles, so that a periodic sequence of four different cycles are possible in the building of a bobbin.

The curve showing the value of the traversing stroke starts at its minimum value and reaches its maximum value, taking up 62.5% of the total cycle time in the present example, after only 3 seconds. The traversing stroke is then shortened again, with the new minimum value of the traversing stroke being greater than the stroke at the beginning T=0. Just as the traversing frequency has a different value at the beginning of the second cycle (T=16 sec.) than at the beginning of the first cycle, the traversing stroke is greater at T=16 sec. at the beginning of the second cycle, than at the beginning of the first. As can be seen from the third curve, yarn tension has dropped to a minimum value in this state, while it is greatest at the beginning and at the end of the maximum traversing stroke. As can be seen in the diagram of FIG. 1, the decrease of traversing frequency is linear, as is its increase to the end of the cycle. In the same manner the reversal of stroke shortening is linear, as is the stroke shortening at the end of the cycle. As can be seen in FIG. 1, the time share of the minimum frequency value is smaller in all cycles than the cycle time share of the maximum stroke. The yarn tension fluctuates around a mean value and is greatest at the beginning of the first cycle while decreasing considerably to the end of the fourth cycle.

Figure 2:
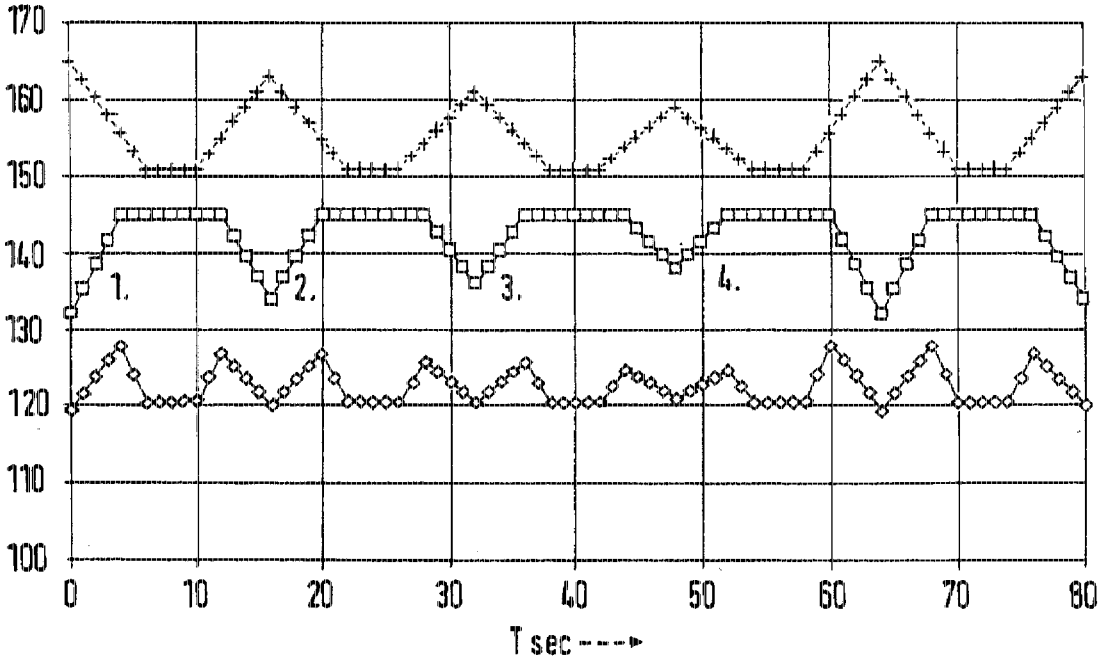
FIG. 2 is a similar diagram to FIG. 1, also with four winding cycles, but here with a different evolution of frequency and stroke shortening in time

FIG. 2 shows a similar picture as FIG. 1, however here the duration of the minimum value of the frequency and the duration of the maximum value of the stroke are clearly different. The former amounts to 25% of the total cycle time, the maximum value of the traversing stroke takes up 50% of the total cycle time. The fluctuations in yarn tension during winding are less than in the cycles shown in FIG. 1. The advantage with a process as shown in FIG. 1 is that through the long duration of the maximum traversing stroke, many yarns are deposited in the outer area of the bobbin edge and that due to the short duration of the minimum traversing frequency value the danger of ribbon winding on the bobbin is minimal. The advantage of winding according to a process of FIG. 2 is that the yarn tension fluctuations are very small, the edges of the bobbins are wider thanks to the shorter duration of the maximum stroke. However there is a danger here that the bobbin may come into an area of ribbon winding. If the duration of the minimum value of the traversing frequency is selected to be equal to the duration of the maximum value of the stroke, the yarn tension fluctuation can become zero. The condition for this is of course that the minimum value and the maximum value start and end at the same time. Such a process can however not be used in practice, since ribbon winding will certainly occur on the bobbin, and this is very disadvantageous for the further processing of the bobbin.

Figure 3:
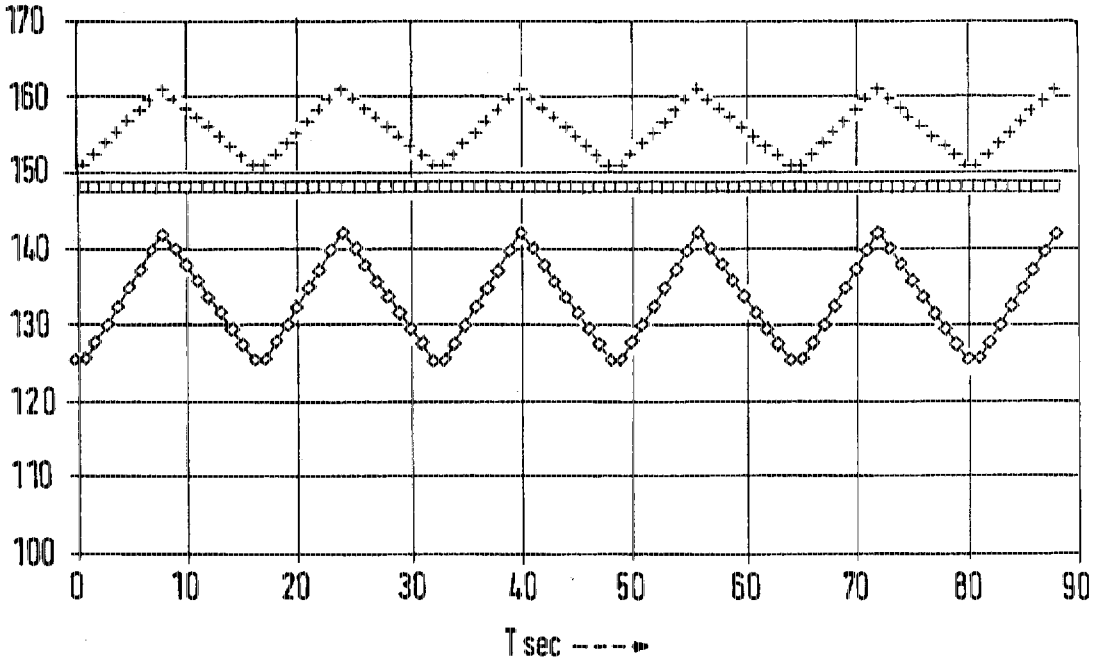
FIG. 3 is a diagram schematically showing the yarn tension fluctuation in a winding process according to the state of the art.

FIG. 3 shows a diagram according to the state of the art mentioned in the beginning. In this process for the winding of a yarn-the traversing stroke, i.e. the stroke of the yarn guide, remains constant. Only the frequency of the yarn guide is changed in order to avoid ribbon winding on the bobbin. This diagram clearly shows that the yarn tension fluctuations are considerably greater than in the process according to the invention. The effect of the so-called edge distribution cannot be shown here. It has no influence on yarn tension.

In addition to the constant values of minimum frequency and maximum stroke shown in FIGS. 1 and 2, it is also possible according to the present process according to the invention not to keep these values entirely constant but to subject them to slight fluctuations, or to make the transitions from minimum to maximum value not exactly linear. It is however also possible to make the transitions to the maximum values in the transferred sense with a transition. Regarding the traversing frequency, it should be noted that the magnitude of its mean value depends on the delivery speed of the yarn and also on the cross-winding of the yarn and is not different from the state of the art. The time duration of a cycle must be selected as a function of the cross-winding of the yarn and of the yarn delivery speed. The cycle duration for 150 m/minute delivery and 44° crossing angle is approximately 13 seconds, and with 30° crossing angle is approximately 19 seconds.

It should be apparent to those skilled in the art that various modifications and variations can be made in the present invention without departing from the scope and spirit of the invention. It is intended that the present invention cover such modifications and variations as come within the scope of the appended claims and their equivalents.

I claim:

1. A winding process for winding delivered yarn into a cross-wound bobbin in a textile machine, wherein the yarn is deposited in a traversing stroke by a traversing movement of a yarn guide for distribution on a bobbin, comprising:

intermittently decreasing the traversing stroke from a maximum value to a minimum value and subsequently increasing the value of the traversing stroke from the minimum value back to a relatively constant maximum value for a predetermined period of time;

decreasing the traversing frequency of the yarn guide traversing movement to a relatively constant minimum value substantially simultaneously with said increasing of the traversing stroke from the minimum value back to the relatively constant maximum value, and maintaining said constant minimum value for a predetermined period of time;

increasing the traversing frequency of the yarn guide traversing movement from the constant minimum value after the predetermined period of time;

whereby the duration of said decreasing the traversing frequency of the yarn guide traversing movement is shorter that the duration of the maximum value of the traversing stroke; and wherein said above steps comprise a winding cycle.

2. The winding process as in claim 1, wherein the maximum value of the traversing stroke is maintained for generally between 35% and 65% of the total time of the winding cycle.

3. The winding process as in claim 2, wherein the maximum value of the traversing stroke is maintained for generally between 45% and 55% of the total time of the winding cycle.

4. The winding process as in claim 1, wherein said decreasing of the traversing frequency is maintained for generally between 10% and 30% of the total time of the winding cycle.

5. The winding process as in claim 4, wherein said decreasing of the traversing frequency is maintained for generally between 12% and 25% of the total time of the winding cycle.

6. The winding process as in claim 1, comprising repeating said cycle in the winding process with subsequent said cycles differing in the duration of said decreasing of the traversing stroke.

7. The winding process as in claim 6, wherein said difference in the duration of said decreasing of the traversing stroke in subsequent cycles is linear.

8. The winding process as in claim 6, wherein each said cycle is equally long in duration.

9. The winding process as in claim 1, comprising repeating said cycle in the winding process with subsequent said cycles differing in the duration of said decrease of the traversing frequency.

10. The winding process as in claim 9, wherein said difference in the duration of said decrease of the traversing frequency in subsequent cycles is linear.

11. The winding process as in claim 9, wherein each said cycle is equally long in duration.

12. The winding process as in claim 1, wherein the maximum value of the traversing frequency coincides with the minimum value of the traversing stroke.

* * * * *